US010277997B2

(12) United States Patent
Chen et al.

(10) Patent No.: US 10,277,997 B2
(45) Date of Patent: Apr. 30, 2019

(54) PROCESSING OBJECT-BASED AUDIO SIGNALS

(71) Applicant: Dolby Laboratories Licensing Corporation, San Francisco, CA (US)

(72) Inventors: Lianwu Chen, Beijing (CN); Lie Lu, San Francisco, CA (US); Dirk Jeroen Breebaart, Ultimo (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/749,750

(22) PCT Filed: Aug. 4, 2016

(86) PCT No.: PCT/US2016/045512

§ 371 (c)(1),
(2) Date: Feb. 1, 2018

(87) PCT Pub. No.: WO2017/027308

PCT Pub. Date: Feb. 16, 2017

(65) Prior Publication Data

US 2018/0227691 A1 Aug. 9, 2018

Related U.S. Application Data

(60) Provisional application No. 62/209,610, filed on Aug. 25, 2015.

(30) Foreign Application Priority Data

Sep. 17, 2015 (EP) ..... 15185648

(51) Int. Cl.

| | |
|---|---|
| ***G10L 19/008*** | (2013.01) |
| ***H04S 3/00*** | (2006.01) |
| ***H04R 3/12*** | (2006.01) |

(52) U.S. Cl.

CPC ..... *H04S 3/008* (2013.01); *G10L 19/008* (2013.01); *H04R 3/12* (2013.01); *H04S 2400/11* (2013.01)

(58) Field of Classification Search

None

See application file for complete search history.

(56) References Cited

U.S. PATENT DOCUMENTS

| | | | |
|---|---|---|---|
| 5,890,125 | A | 3/1999 | Davis |
| 7,356,465 | B2 | 4/2008 | Tsingos |

(Continued)

FOREIGN PATENT DOCUMENTS

| | | |
|---|---|---|
| WO | 2014/046916 | 3/2014 |
| WO | 2014/099285 | 6/2014 |

(Continued)

OTHER PUBLICATIONS

Ruta, A. et al "Compressive Clustering of High-Dimensional Data" 11th International Conference on Machine Learning and Applications (ICMLA), Dec. 12-15, 2012, pp. 380-385.

(Continued)

*Primary Examiner* — James K Mooney

(57) ABSTRACT

Example embodiments disclosed herein relate to audio signal processing. The audio signal has multiple audio objects. A method of processing an audio signal is disclosed. The method includes obtaining an object position for each of the audio objects; and determining cluster positions for grouping the audio objects into clusters based on the object positions, a plurality of object-to-cluster gains, and a set of metrics. The metrics indicate a quality of the cluster positions and a quality of the object-to-cluster gains, each of the cluster positions is a centroid of a respective one of the clusters, and one of the object-to-cluster gains defines a ratio of the respective audio object in one of the clusters. The method also includes determining the object-to-cluster gains (Continued)

based on the object positions, the cluster positions and the set of metrics; and generating a cluster signal based on the determined cluster positions and object-to-cluster gains. Corresponding system and computer program product are also disclosed.

13 Claims, 2 Drawing Sheets

(56) References Cited

U.S. PATENT DOCUMENTS

| | | | | |
|---|---|---|---|---|
| 7,558,762 | B2 | 7/2009 | Owechko | |
| 7,840,410 | B2 | 11/2010 | Fellers | |
| 8,068,629 | B2 | 11/2011 | Klinkby | |
| 8,380,524 | B2 | 2/2013 | Wu | |
| 8,386,267 | B2 | 2/2013 | Morii | |
| 8,457,957 | B2 | 6/2013 | Wu | |
| 8,719,011 | B2 | 5/2014 | Morii | |
| 9,805,725 | B2 | 10/2017 | Crockett | |
| 2005/0114121 | A1* | 5/2005 | Tsingos | H04S 7/30 704/220 |
| 2006/0140412 | A1 | 6/2006 | Villemoes | |
| 2013/0142341 | A1 | 6/2013 | Del Galdo | |
| 2013/0282386 | A1 | 10/2013 | Vilermo | |
| 2014/0023196 | A1 | 1/2014 | Xiang | |
| 2014/0023197 | A1* | 1/2014 | Xiang | H04S 1/007 381/17 |

FOREIGN PATENT DOCUMENTS

| | | |
|---|---|---|
| WO | 2014/184706 | 11/2014 |
| WO | 2014/187990 | 11/2014 |
| WO | 2015/017037 | 2/2015 |
| WO | 2015/105748 | 7/2015 |

OTHER PUBLICATIONS

Nikunen, J. et al "Direction of Arrival Based Spatial Covariance Model for Blind Sound Source Separation" IEEE Transactions on Audio, Speech, and Language Processing, vol. 22, Issue 3, Mar. 2014, pp. 727-739.

Tsingos, N. et al "Perceptual Audio Rendering of Complex Virtual Environments" ACM Transactions on Graphics, vol. 23, No. 3, Aug. 1, 2004, pp. 249-258.

* cited by examiner

PROCESSING OBJECT-BASED AUDIO SIGNALS

CROSS-REFERENCE TO RELATED APPLICATION

This application claims priority to Chinese Patent Application No. 201510484949.8, filed Aug. 7, 2015; United States Provisional Application No. 62/209,610, filed Aug. 25, 2015; and European Application No. 15185648.1, filed Sep. 17, 2015; all of which are incorporated herein by reference in their entirety.

TECHNOLOGY

Example embodiments disclosed herein generally relate to object-based audio processing, and more specifically, to a method and system for generating cluster signals from the object-based audio signals.

BACKGROUND

Traditionally, audio content of multi-channel format (for example, stereo, 5.1, 7.1, and the like) are created by mixing different audio signals in a studio, or generated by recording acoustic signals simultaneously in a real environment. More recently, object-based audio content has become more and more popular as it carries a number of audio objects and audio beds separately so that it can be rendered with much improved precision compared with traditional rendering methods. The audio objects refer to individual audio elements that may exist for a defined duration of time but also contain spatial information describing the position, velocity, and size (as examples) of each object in the form of metadata. The audio beds or beds refer to audio channels that are meant to be reproduced in predefined, fixed speaker locations.

For example, cinema sound tracks may include many different sound elements corresponding to images on the screen, dialogs, noises, and sound effects that emanate from different places on the screen and combine with background music and ambient effects to create the overall auditory experience. Accurate playback requires that sounds be reproduced in a way that corresponds as closely as possible to what is shown on screen with respect to sound source position, intensity, movement, and depth.

During transmission of audio signals, beds and objects can be sent separately and then used by a spatial reproduction system to recreate the artistic intent using a variable number of speakers in known physical locations. In some situations, there may be tens of or even hundreds of individual audio objects contained for audio content rendering. As a result, the advent of such object-based audio data has significantly increased the complexity of rendering audio data within playback systems.

The large number of audio signals present in object-based content poses new challenges for the coding and distribution of such content. In some distribution and transmission systems, a transmission capacity may be provided with large enough bandwidth available to transmit all audio beds and objects with little or no audio compression. In some cases, however, such as Blu-ray disc, broadcast (cable, satellite and terrestrial), mobile (3G and 4G) and over the top (OTT) distribution, the available bandwidth is not capable of transmitting all of the bed and object information created by an audio mixer. While audio coding methods (lossy or lossless) may be applied to the audio to reduce the required bandwidth, audio coding may not be sufficient to reduce the bandwidth required to transmit the audio, particularly over very limited networks such as mobile 3G and 4G networks.

Some existing methods utilize clustering of the audio objects so as to reduce the number of input objects and beds into a smaller set of output clusters. As such, the computational complexity and storage requirements are reduced. However, the accuracy may be compromised because the existing methods only allocate the objects in a relatively coarse manner.

SUMMARY

Example embodiments disclosed herein propose a method and system for processing an audio signal for reducing the number of audio objects by allocating these objects into the clusters, while remaining the performance in terms of accuracy of spatial audio representation.

In one aspect, example embodiments disclosed herein provide a method of processing an audio signal is disclosed. The audio signal has multiple audio objects. The method includes obtaining an object position for each of the audio objects; and determining cluster positions for grouping the audio objects into clusters based on the object positions, a plurality of object-to-cluster gains, and a set of metrics. The metrics indicate a quality of the cluster positions and a quality of the object-to-cluster gains, each of the cluster positions is a centroid of a respective one of the clusters, and one of the object-to-cluster gains defines a ratio of the respective audio object in one of the clusters. The method also includes determining the object-to-cluster gains based on the object positions, the cluster positions and the set of metrics; and generating a cluster signal based on the determined cluster positions and object-to-cluster gains.

In another aspect, example embodiments disclosed herein provide a system for processing an audio signal. The audio signal has multiple audio objects. The system includes an object position obtaining unit configured to obtain an object position for each of the audio objects; and a cluster position determining unit configured to determine cluster positions for grouping the audio objects into clusters based on the object positions, a plurality of object-to-cluster gains, and a set of metrics. The metrics indicate a quality of the cluster positions and a quality of the object-to-cluster gains, each of the cluster positions is a centroid of a respective one of the clusters, and one of the object-to-cluster gains defines a ratio of the respective audio object in one of the clusters. The system also includes an object-to-cluster gain determining unit configured to determine the object-to-cluster gains based on the object positions, the cluster positions and the set of metrics; and a cluster signal generating unit configured to generate a cluster signal based on the determined cluster positions and object-to-cluster gains.

Through the following description, it would be appreciated that the object-based audio signals containing the audio objects and audio beds are greatly compressed for data streaming, and thus the computational and bandwidth requirements for those signals are significantly reduced. The accurate generation of a number of clusters is able to reproduce an auditory scene with high precision in which audiences may correctly perceive the positioning of each of the audio objects, so that an immersive reproduction can be achieved accordingly. Meanwhile, a reduced requirement on data transmission rate thanks to the effective compression allows a less compromised fidelity for any of the existing playback systems such as a speaker array and a headphone.

DESCRIPTION OF DRAWINGS

Through the following detailed descriptions with reference to the accompanying drawings, the above and other objectives, features and advantages of the example embodiments disclosed herein will become more comprehensible. In the drawings, several example embodiments disclosed herein will be illustrated in an example and in a non-limiting manner, wherein.

Throughout the drawings, the same or corresponding reference symbols refer to the same or corresponding parts.

DESCRIPTION OF EXAMPLE EMBODIMENTS

Figure 1:
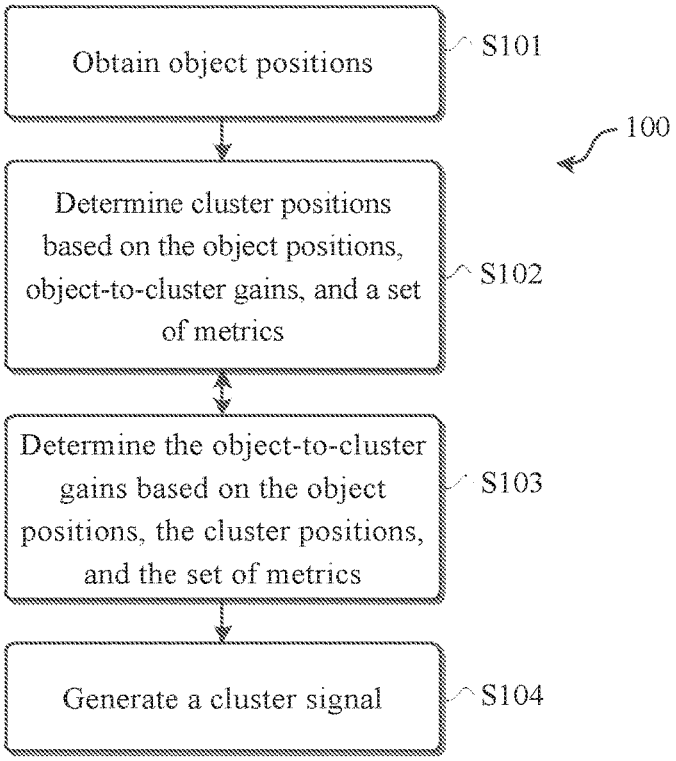
FIG. 1 illustrates a flowchart of a method of processing an audio signal in accordance with an example embodiment.

Principles of the example embodiments disclosed herein will now be described with reference to various example embodiments illustrated in the drawings. It should be appreciated that the depiction of these embodiments is only to enable those skilled in the art to better understand and further implement the example embodiments disclosed herein, not intended for limiting the scope in any manner.

Object-based audio signals are used to be processed by a system which is able to handle the audio objects and their respective metadata. Information such as position, speed, width and the like is provided within the metadata. These object-based audio signals are normally produced by mixers in studios and are adapted to be rendered by different systems with appropriate processors. However, the mixing and the rendering processes are not to be illustrated in detail because the embodiments disclosed herein mainly focus on how to allocate the objects into a reduced number of clusters while remaining the performance in terms of accuracy of spatial audio representation.

It may be assumed that audio signals are segmented into individual frames which are subject to the analysis throughout the descriptions. Such segmentation may be applied on time-domain waveforms, while filter banks or any other transform domain suitable for the example embodiments disclosed herein are applicable.

FIG. 1 illustrates a flowchart of a method 100 of processing an audio signal in accordance with an example embodiment. In step S101, an object position for each of the audio objects is obtained. The object-based audio objects usually contain metadata providing positional information regarding the objects. Such information is useful for various processing techniques in case that the object-based audio content is to be rendered with higher accuracy.

In step S102, cluster positions for grouping the audio objects into clusters are determined based on the object positions, a plurality of object-to-cluster gains, and a set of metrics. The metrics indicate a quality of the determined cluster positions and a quality of the determined object-to-cluster gains. For example, such a quality can be represented by a cost function which will be described below. The cluster position refers to a centroid of a cluster grouped from a number of different audio objects spatially close to each other. The cluster may be selected in different ways including, for example, randomly selecting the cluster positions; applying an initial clustering on the plurality of audio objects to obtain the cluster positions (for example, k-means clustering); and determining the cluster positions for a current time frame of the audio signal based on the cluster positions for a previous time frame of the audio signal. One of the object-to-cluster gains defines a ratio of each of the audio objects grouped into a corresponding one of the clusters, and these gains indicate how the audio objects are grouped into the clusters. Hence, given a plurality of object-to-cluster gains, cluster positions for grouping the audio objects into clusters may be determined based on the object positions and a set of metrics. The metrics may indicate the quality of the cluster positions and the quality of the object-to-cluster gains. Each of the cluster positions may correspond to a centroid of a respective one of the clusters. The plurality of object-to-cluster gains may indicate for each one of the audio objects gains for determining a reconstructed object position of the audio object from the cluster positions of the clusters.

In step S103, the object-to-cluster gains are determined based on the object positions, the cluster positions and the set of metrics. Each of the audio objects can be assigned with an object-to-cluster gain for acting as a coefficient. In other words, if the object-to-cluster gain is large for a particular audio object with respect to one of the clusters, the object may be spatially in the vicinity of that cluster. Of course, large object-to-cluster gains for one audio object with respect to some of the clusters means that the object-to-cluster gains for the same audio object with respect to other clusters may be relatively small. Hence, a relatively large object-to-cluster gain for an audio object with respect to a cluster may indicate that the audio object is in a relatively close vicinity of the cluster, and vice versa. The plurality of object-to-cluster gains may comprise object-to-cluster gains for each of the plurality of audio objects with respect to each of the clusters.

The steps S102 and S103 define that the determination of the cluster position is partly based on the object-to-cluster gains and the determination of the object-to-cluster gains is partly based on the object positions, meaning that the two determining steps are mutually dependent. The quality of the determination can be indicated by a value associated with the metrics. Normally, a decreasing or a converging trend of a value associated with the metrics to a predetermined value can be used to maintain the determining process until the quality is satisfying enough. A predefined threshold may be set so it can be compared with the value associated with the metrics. As a result, in some embodiments, the determination of the cluster positions and the object-to-cluster gains will be alternately performed until the value is smaller than the predefined threshold. Hence, the steps of determining cluster positions S102 and determining the object-to-cluster gains S103 may be mutually dependent and/or part of an iteration process until a predetermined condition is met.

Alternatively, another predefined threshold may be set so it can be compared with a changing rate of the value associated with the metrics. As a result, in some embodiments, the cluster positions and the object-to-cluster gains will keep the determining process until a changing rate (for example, a descending rate) of the value associated with the metrics is smaller than the predefined threshold.

In an embodiment, a cost function can be suitable for representing the value associated with the metrics, and thus it may reflect the quality of the determined cluster positions and the quality of the determined object-to-cluster gains. Therefore, the calculations concerning the cost function will be explained in detail in the following paragraphs.

The cost function includes various additive terms by considering various metrics of a clustering process. Each metric, in one embodiment, may include (A) a position error between positions of reconstructed audio objects in the cluster signal and positions of the audio objects in the audio signal; (B) a distance error between positions of the clusters and positions of the audio objects; (C) a deviation of a sum of the object-to-cluster gains from an unit one; (D) a rendering error between rendering the cluster signal to one or more playback systems and rendering the audio objects in the audio signal to the one or more playback systems; and (E) an inter-frame inconsistency of a variable between a current time frame and a previous time frame. The cost function is useful for comparing the signals before and after the clustering process, namely, before and after the audio objects being grouped into several clusters. Therefore, the cost function may be an effective indicator reflecting the quality of the clustering.

As for the metric (A), since the input audio objects may be reconstructed by output clusters, the error between the original object position and the reconstructed object position can be used to measure a spatial position difference of the object, describing how accurate the clustering process is for positional information.

The term "position error" may be related to the spatial location of an audio object after distributing its signal across output clusters position $p_c$, which is related to the spatial position of the audio object before and after the clustering process. In particular, when the original position is represented by a vector $\vec{p}_o$ (for example, it may be represented by 3 Cartesian coordinates), the reconstructed position $\vec{p}_0'$ can be formulated as an amplitude-panned source as:

$$\vec{p}_o' = \sum_c g_{o,c}\vec{p}_c \tag{1}$$

Then, a cost $E_p$ associated with the position error can be formulated as:

$$E_P = \sum_o w_o \left\| \vec{p}_o \sum_c g_{o,c} - \sum_c g_{o,c}\vec{p}_c \right\|^2 \tag{2}$$

where $w_o$ represents the weight of $o^{th}$ object, which can be the energy, loudness or partial loudness of the object. $g_{o,c}$ represents the gain of rendering $o^{th}$ object to $c^{th}$ cluster, or the object-to-cluster gain.

As for the metric (B), since rendering audio objects into clusters with large distance therebetween may introduce large timbre changes, the object-to-cluster distance can be used to measure the timbre changes. The timbre changes are expected when an audio object is not represented by a point source (a cluster) but instead by a phantom source panned across a multitude of clusters. It is a well-known phenomenon that amplitude-panned sources can have a different timbre than point sources due to the comb-filter interactions that can occur when one and the same signal is reproduced by two or more (virtual) speakers.

The term "distance error" can be represented by $E_D$, which may be deducted from a distance between the position of the audio object $\vec{p}_o$ and the cluster position $\vec{p}_c$, reflecting an increase in cost if an audio object is to be represented by clusters far away from the original object position:

$$E_D = \sum_o w_o \sum_c g_{o,c}^2 \|\vec{p}_o - \vec{p}_c\|^2 \tag{3}$$

As for the metric (C), the object-to-cluster gain normalization error can be used to measure the energy (loudness) changes before and after the clustering process.

The term "deviation" can be represented by $E_N$, which is related to gain normalization, or more specifically, to a deviation from the sum of gains for a specific cluster centroid being different from unit (one):

$$E_N = \sum_o w_o \left(1 - \sum_c g_{o,c}\right)^2 \tag{4}$$

As for the metric (D), since there are different rendering outputs for different playback systems, one or several reference playback systems for this metric, for example, the single channel quality on 7.1.4 speaker playback system may need to be specified. By comparing the difference between the rendering outputs of original objects and the rendering outputs of clusters on the specific reference playback systems, the single channel quality of the clustering results can be measured.

The term "rendering error" can be represented by $E_R$, which is related to an error for a reference playback system, which is to measure the difference between rendering original objects to the reference playback system and rendering clusters to the reference playback system, the reference playback system may be binaural, 5.1, 7.1.4, 9.1.6, etc.

$$E_R = \sum_s n_s \sum_o w_o \left(g_{o,s} - \sum_c g_{o,c} g_{c,s}\right)^2 \text{ with} \tag{5}$$

$$n_s = \frac{1}{\sum_c w_o g_{o,s}^2 + a} \tag{6}$$

where $g_{o,s}$ represents the gain of rendering $o^{th}$ object to $s^{th}$ output channel, $g_{c,s}$ represents the gain of rendering $c^{th}$ cluster to $s^{th}$ output channel, and $n_s$ is to normalize the rendering difference so that the rendering error on each channel are comparable. Parameter a is to avoid introducing a too large rendering difference when the signal on the reference playback system is very small or even zero.

In one embodiment, the summation over speakers using index s may be performed over one or more speakers of a particular predetermined speaker layout. Alternatively, the clusters and the objects are rendered to a larger set of loudspeakers covering multiple speaker layouts simultaneously. For example, if one layout is a 5-channel layout, and a second layout would comprise of a two-channel layout, both the clusters and objects can be rendered to the 5-channel and two-channel layouts in parallel. Subsequently, the error term $E_R$ is evaluated over all 7 speakers to jointly optimize the error term for two speaker layouts simultaneously.

As for the metric (E), since the clustering process is performed as a function of frame, inter-frame inconsistency of some variables (such as object-to-cluster gains, cluster position and reconstructed object position) in the clustering process can be used to measure this objective metric. In one embodiment, the inter-frame inconsistency of the reconstructed object position may be used to measure the temporal smoothness of clustering results.

The term "inter-frame inconsistency" can be represented by $E_C$, which is related to the inter-frame inconsistency of a particular variable of the reconstructed object. Assuming $\vec{p}_o$ (t) and $\vec{p}_o$ (t−1) are the original object position in t frame and t−1 frame, $\vec{p}'_o$ (t) and $\vec{p}'_o$ (t−1) are the reconstructed object position in t frame and t−1 frame, and $\vec{q}_o$ (t) is the target reconstructed object position in t frame. As defined by Equation (1) above, the reconstructed position $\vec{p}_o'$ can be formulated as an amplitude-panned source.

For preserving the inter-frame smoothness, the target reconstructed object position in t frame can be formulated as a combination of the reconstructed object position in t−1 frame and the offset of the object $\Delta_o$ from t−1 frame to t frame:

$$\vec{q}_o(t)=\vec{p}'_o(t-1)+\Delta_o(t-1,t)=\vec{p}'_o(t-1)+\vec{p}_o(t)-\vec{p}_o(t-1) \tag{7}$$

Then, a cost $E_C$ associated with the inter-frame inconsistence can be formulated as:

$$E_C=\sum_o w_o\left\|\vec{q}_o\sum_c g_{o,c}-\sum_c g_{o,c}\vec{p}_c\right\|^2 \tag{8}$$

The above metrics may be measured individually, or as an overall cost being the combination of the metrics described above. In one embodiment, the overall cost can be a weighted sum of the cost terms (A) to (E):

$$E=\alpha_P E_P+\alpha_D E_D+\alpha_N E_N+\alpha_R E_R+\alpha_C E_C \tag{9}$$

In another embodiment, the total cost could be also the maximum of the cost terms:

$$E=\max\{\alpha_P E_P\alpha_D E_D,\alpha_N E_N,\alpha_R E_R,\alpha_C E_C\} \tag{10}$$

where $\alpha_P$, $\alpha_D$, $\alpha_N$, $\alpha_R$, $\alpha_C$ represent the weights of the cost terms (A) to (E).

The gains $g_{o,c}$, position $\vec{p}_o$, $\vec{q}_o$ and $\vec{p}_c$ can be written as a matrix:

$$G_{OC}=\begin{bmatrix}\vec{g}_1\\ \vdots\\ \vec{g}_O\end{bmatrix} \tag{11}$$

$$P_O=\begin{bmatrix}\vec{p}_1\\ \vdots\\ \vec{p}_O\end{bmatrix} \tag{12}$$

$$Q_O=\begin{bmatrix}\vec{q}_1\\ \vdots\\ \vec{q}_O\end{bmatrix} \tag{13}$$

-continued $$P_C=\begin{bmatrix}\vec{p}_1\\ \vdots\\ \vec{p}_C\end{bmatrix} \tag{14}$$

The object weight can be written as a diagonal matrix:

$$W_O=\begin{bmatrix}w_1 & \dots & 0\\ \vdots & \ddots & \vdots\\ 0 & \dots & w_O\end{bmatrix}, \tag{15}$$

Then, the different cost function terms can be written as below:

$$\begin{aligned}E_P&=\sum_o w_o\left\|\vec{g}_o\vec{1}_C\vec{p}_o-\vec{g}_oP_C\right\|^2\\&=\|W_O^{1/2}(\mathrm{diag}(G_{OC}1_{C*O})P_O-G_{OC}P_C)\|^2\\&=\|W_O^{1/2}(HP_O-G_{OC}P_C)\|^2\end{aligned} \tag{16}$$

where $H=\mathrm{diag}(G_{OC}1_{C*O})$, diag( ) represents the operation to obtain the diagonal matrix. $\vec{1}_C$ represents an all−1 vector with C×1 elements, or a vector of length C with all coefficients equal to +1, and $1_{C*O}$ represents an all−1 matrix with C×O elements.

$$\begin{aligned}E_D&=\sum_o w_o\sum_c g_{o,c}^2\|\vec{p}_o-\vec{p}_c\|^2\\&=\sum_c\sum_o w_o g_{o,c}^2\|\vec{p}_o-\vec{p}_c\|^2=\sum_o w_o\vec{g}_o\Lambda_o\vec{g}_o^T\end{aligned} \tag{17}$$

where $\Lambda_o$ represents a diagonal matrix with diagonal elements $\lambda_o(c, c)=\|\vec{p}_o-\vec{p}_c\|^2$, $$E_N=\sum_o w_o\left(1-\sum_c g_{o,c}\right)^2=\sum_o w_o\left(1-2\vec{g}_o\vec{1}_C+\vec{g}_o\vec{1}_C\vec{1}_C^T\vec{g}_o^T\right) \tag{18}$$

$$\begin{aligned}E_R&=\sum_o w_o\sum_s n_s\left(g_{o,s}-\sum_c g_{o,c}g_{c,s}\right)^2\\&=\sum_o w_o(\vec{g}_{o\to s}-\vec{g}_oG_{CS})N_s(\vec{g}_{o\to s}-\vec{g}_oG_{CS})^T\end{aligned} \tag{19}$$

where $N_S$ represents a diagonal matrix with diagonal elements $n_S$, $\vec{g}_{o\to S}$ represents a vector indicating the gains of rendering the $o^{th}$ object to reference speakers, $G_{CS}$ represents the matrix containing the cluster to speaker gains.

$$E_C=\sum_o w_o\left\|\vec{g}_o\vec{1}_C\vec{q}_o-\vec{g}_oP_C\right\|^2=\|W_O^{1/2}(HQ_O-G_{OC}P_C)\|^2 \tag{20}$$

With the terms defined above, details of the determining processes will be given below in the descriptions.

Returning to FIG. 1, in step S104, a cluster signal to be rendered is generated based on the determined cluster positions and object-to-cluster gains in the steps S102 and S103. The generated cluster signal usually has a much smaller number of the clusters than the number of audio objects contained in the audio content or audio signal, so that the requirements on computational resources for rendering the auditory scene are significantly reduced.

Figure 2:
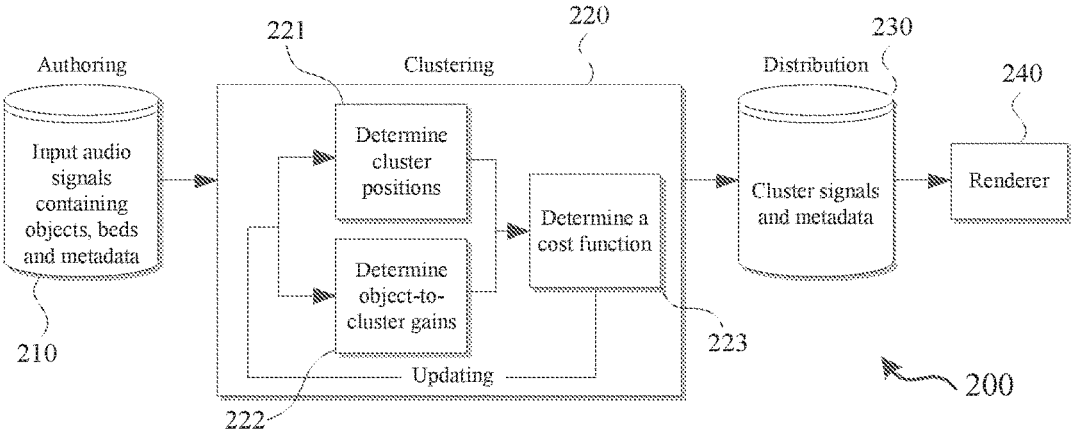
FIG. 2 illustrates an example flow of the object-based audio signal processing in accordance with an example embodiment.

FIG. 2 illustrates an example flow 200 of the object-based audio signal processing in accordance with an example embodiment.

A block 210 may produce a large number of audio objects, audio beds and metadata contained within the audio content to be processed in accordance with the example embodiments. A block 220 is used for the clustering process which groups the multiple audio objects into a relatively small number of clusters. At a block 230, the cluster signal along with newly generated metadata are output so as to be rendered by a block 240 representing a renderer for a particular audio playback system. In other words, an overview of an ecosystem involving authoring 210, clustering 220, distribution 230, and rendering 240 is shown in FIG. 2. After clustering, the cluster signals and metadata can be distributed to a multitude of renderers aiming at different loudspeaker playback setups or headphone reproduction.

It may be assumed that the audio content is represented by beds (or static objects, or traditional channels) and (dynamic) objects. An object includes an audio signal and associated metadata indicating the spatial rendering information as a function of time. To reduce the data rate of a multitude of beds and objects, clustering is applied which takes as input the multitude of beds and objects, and produces a smaller set of objects (referred to as clusters) to represent the original content in a data-efficient manner.

The clustering process typically includes both determining a set of cluster positions and grouping (or rendering) the objects into the clusters. The two processes have complicated inter-dependencies, as the rendering of objects into clusters may depend on the clustering positions, while the overall presentation quality may depend on the cluster positions and the object-to-cluster gains. It is desired to optimize cluster positions and object-to-cluster gains in a synergetic manner.

In one embodiment, the optimized object-to-cluster gains and cluster positions can be obtained by minimizing the cost function as discussed above. However, since there is no closed form solution to obtain optimal object-to-cluster gains and cluster positions together, one example solution is to use EM (expectation maximization)-like iterative process to determine the object-to-cluster gains and cluster positions respectively. In the E step, given the cluster positions $P_C$, the object-to-cluster gains $G_{OC}$ can be determined by minimizing the cost function; In the M step, given the object-to-cluster gains $G_{OC}$, the cluster positions $P_C$ can be determined by minimizing the cost function. A stop criterion is used to decide whether to continue or stop the iteration.

Given the cluster position $P_C$, the object-to-cluster gains $G_{OC}$ that achieve the minimum of the cost function E can be obtained at a block 222 in FIG. 2 by solving the following function:

$$\frac{\partial}{\partial G_{OC}}E = \alpha_P\frac{\partial}{\partial G_{OC}}E_P + \alpha_D\frac{\partial}{\partial G_{OC}}E_D + \alpha_R\frac{\partial}{\partial G_{OC}}E_R + \alpha_C\frac{\partial}{\partial G_{OC}}E_C + \alpha_N\frac{\partial}{\partial G_{OC}}E_N = 0 \tag{21}$$

where, for the metric (A):

$$\frac{\partial}{\partial G_{OC}}E_P = \begin{bmatrix} \frac{\partial}{\partial \vec{g}_1}E_P \\ \frac{\partial}{\partial \vec{g}_2}E_P \\ \vdots \\ \frac{\partial}{\partial \vec{g}_O}E_P \end{bmatrix} = \begin{bmatrix} 2w_1\vec{g}_1\left(\vec{1}_C\vec{p}_1\vec{p}_1^T\vec{1}_C^T - P_C\vec{p}_1^T\vec{1}_C^T - \vec{1}_C\vec{p}_1P_C^T + P_CP_C^T\right) \\ 2w_2\vec{g}_2\left(\vec{1}_C\vec{p}_2\vec{p}_2^T\vec{1}_C^T - P_C\vec{p}_2^T\vec{1}_C^T - \vec{1}_C\vec{p}_2P_C^T + P_CP_C^T\right) \\ \vdots \\ 2w_O\vec{g}_O\left(\vec{1}_C\vec{p}_o\vec{p}_o^T\vec{1}_C^T - P_C\vec{p}_o^T\vec{1}_C^T - \vec{1}_C\vec{p}_oP_C^T + P_CP_C^T\right) \end{bmatrix}$$

for the metric (B):

$$\frac{\partial}{\partial G_{OC}}E_D = \begin{bmatrix} \frac{\partial}{\partial \vec{g}_1}E_D \\ \frac{\partial}{\partial \vec{g}_2}E_D \\ \vdots \\ \frac{\partial}{\partial \vec{g}_O}E_D \end{bmatrix} = \begin{bmatrix} w_1\vec{g}_1(\Lambda_1 + \Lambda_1^T) \\ w_2\vec{g}_2(\Lambda_2 + \Lambda_2^T) \\ \vdots \\ w_O\vec{g}_O(\Lambda_O + \Lambda_O^T) \end{bmatrix}$$

for the metric (C):

$$\frac{\partial}{\partial G_{OC}}E_N = \begin{bmatrix} \frac{\partial}{\partial \vec{g}_1}E_N \\ \frac{\partial}{\partial \vec{g}_2}E_N \\ \vdots \\ \frac{\partial}{\partial \vec{g}_O}E_N \end{bmatrix} = \begin{bmatrix} -2w_1\vec{1}_C^T + 2w_1\vec{g}_1\vec{1}_C\vec{1}_C^T \\ -2w_2\vec{1}_C^T + 2w_2\vec{g}_2\vec{1}_C\vec{1}_C^T \\ \vdots \\ -2w_O\vec{1}_C^T + 2w_O\vec{g}_O\vec{1}_C\vec{1}_C^T \end{bmatrix}$$

for the metric (D):

$$\frac{\partial}{\partial G_{OC}}E_R = \begin{bmatrix} \frac{\partial}{\partial \vec{g}_1}E_R \\ \frac{\partial}{\partial \vec{g}_2}E_R \\ \vdots \\ \frac{\partial}{\partial \vec{g}_O}E_R \end{bmatrix} = \begin{bmatrix} w_1(-2\vec{g}_{o\to s}N_sG_{CS}^T + 2\vec{g}_1G_{CS}N_sG_{CS}^T) \\ w_2(-2\vec{g}_{o\to s}N_sG_{CS}^T + 2\vec{g}_2G_{CS}N_sG_{CS}^T) \\ \vdots \\ w_o(-2\vec{g}_{o\to s}N_sG_{CS}^T + 2\vec{g}_OG_{CS}N_sG_{CS}^T) \end{bmatrix}$$

for the metric (E):

$$\frac{\partial}{\partial G_{OC}}E_C = \begin{bmatrix} \frac{\partial}{\partial \vec{g}_1}E_C \\ \frac{\partial}{\partial \vec{g}_2}E_C \\ \vdots \\ \frac{\partial}{\partial \vec{g}_O}E_C \end{bmatrix} = \begin{bmatrix} 2w_1\vec{g}_1\left(\vec{1}_C\vec{q}_1\vec{q}_1^T\vec{1}_C^T - P_C\vec{q}_1^T\vec{1}_C^T - \vec{1}_C\vec{q}_1P_C^T + P_CP_C^T\right) \\ 2w_2\vec{g}_2\left(\vec{1}_C\vec{q}_2\vec{q}_2^T\vec{1}_C^T - P_C\vec{q}_2^T\vec{1}_C^T - \vec{1}_C\vec{q}_2P_C^T + P_CP_C^T\right) \\ \vdots \\ 2w_O\vec{g}_O\left(\vec{1}_C\vec{q}_o\vec{q}_o^T\vec{1}_C^T - P_C\vec{q}_o^T\vec{1}_C^T - \vec{1}_C\vec{q}_oP_C^T + P_CP_C^T\right) \end{bmatrix}$$

By solving the above equation, the object-to-cluster gains matrix is obtained, as:

$$G_{OC} = \begin{bmatrix} \vec{g}_1 \\ \vdots \\ \vec{g}_O \end{bmatrix} \text{ with} \tag{22}$$

$$\vec{g}_o = (\alpha_P B_P + \alpha_D B_D + \alpha_N B_N + \alpha_R B_R + \alpha_C B_C)(\alpha_P A_P + \alpha_D A_D + \alpha_N A_N + \alpha_R A_R + \alpha_C A_C)^{-1} \tag{23}$$

where $B_P=0$ $B_D=0$ $B_N=-2W_o\vec{1}_C^T$ $B_R=W_o(-2\vec{g}_{o\to S}N_SG_{CS}^T)$ $B_C=0$ $A_P=2W_o(\vec{1}_C\vec{p}_o\vec{p}_o^T\vec{1}_C^T-P_C\vec{p}_o^T\vec{1}_C^T-\vec{1}_C\vec{p}_oP_C^T+P_CP_C^T)$ $A_D=w_o(A_o+A_o^T)$ $A_N=2w_o\vec{1}_C\vec{1}_C^T$ $A_R=w_o(2G_{CS}N_SG_{CS}^T)$ $A_C=2w_o(\vec{1}_C\vec{q}_o\vec{q}_o^T\vec{1}_C^T-P_C\vec{q}_o^T\vec{1}_C^T-\vec{1}_C\vec{q}_oP_C^T+P_CP_C^T)$ In view of the above, the object-to-cluster gains can be determined based on the cluster positions.

Given the object to cluster gains $G_{OC}$, the local minimum value of cost function E as well as the optimal cluster position $P_C$ can be obtained at a block 221 in FIG. 2 by solving the following function, $$\frac{\partial}{\partial P_C}E = \alpha_P\frac{\partial}{\partial P_C}E_P + \alpha_D\frac{\partial}{\partial P_C}E_D + \tag{24}$$

-continued $$\alpha_R\frac{\partial}{\partial P_C}E_R + \alpha_C\frac{\partial}{\partial P_C}E_C + \alpha_N\frac{\partial}{\partial P_C}E_N = 0$$

However, since there is not a closed form solution for the above equation, the gradient descent method is utilized to get the optimal cluster position $P_C$:

$$P_C(i+1) = P_C(i) - \sigma\frac{\partial}{\partial P_C}E \tag{25}$$

where i represents the iteration times of the gradient descent, a represents the learning step. The gradient of each cost term can be derived as following, for the metrics (A), (B) and (C):

$$\begin{aligned} E_P &= \left\| W_O^{-\frac{1}{2}}(HP_O - G_{OC}P_C) \right\|^2 \\ &= tr\{(P_O^TH^TW_O^{-1/2} - P_C^TG_{OC}^TW_O^{-1/2})(W_O^{-1/2}HP_O - W_O^{-1/2}G_{OC}P_C)\} \\ &= tr\{P_O^TH^TW_OHP_O - P_O^TH^TW_OG_{OC}P_C - P_C^TG_{OC}^TW_OHP_O + P_C^TG_{OC}^TW_OG_{OC}P_C\} \end{aligned} \tag{26}$$

where tr{ } represents the matrix trace function which sums the diagonal elements of matrix.

$$\frac{\partial}{\partial P_C}E_P = -(P_O^TH^TW_OG_{OC})^T - G_{OC}^TW_OHP_O + (G_{OC}^TW_OG_{OC} + G_{OC}^TW_OG_{OC})P_C \tag{27}$$

$$\frac{\partial}{\partial \vec{p}_c}E_D = -2\sum_o w_og_{o,c}^2\vec{p}_o + 2\vec{p}_c\sum_o w_og_{o,c}^2 \tag{28}$$

$$\frac{\partial}{\partial P_C}E_D = \begin{bmatrix} \frac{\partial}{\partial \vec{p}_1}E_D \\ \frac{\partial}{\partial \vec{p}_2}E_D \\ \vdots \\ \frac{\partial}{\partial \vec{p}_C}E_D \end{bmatrix} = -2\begin{bmatrix} \sum_o w_og_{o,1}^2\vec{p}_o \\ \sum_o w_og_{o,2}^2\vec{p}_o \\ \vdots \\ \sum_o w_og_{o,C}^2\vec{p}_o \end{bmatrix} + 2\begin{bmatrix} \sum_o w_og_{o,1}^2 & \cdots & 0 \\ \vdots & \ddots & \vdots \\ 0 & \cdots & \sum_o w_og_{o,C}^2 \end{bmatrix}P_C = -2(W_OG_{OC}^2)^TP_O + 2\mathrm{diag}(G_{OC}^TW_OG_{OC})P_C \tag{29}$$

$$\frac{\partial}{\partial P_C}E_D = 0 \tag{30}$$

$$\frac{\partial}{\partial P_C}E_R = \begin{bmatrix} \frac{\partial}{\partial p_{1x}}E_R, & \frac{\partial}{\partial p_{1y}}E_R, & \frac{\partial}{\partial p_{1z}}E_R \\ \frac{\partial}{\partial p_{2x}}E_R, & \frac{\partial}{\partial p_{2y}}E_R, & \frac{\partial}{\partial p_{2z}}E_R \\ & \vdots & \\ \frac{\partial}{\partial p_{Cx}}E_R, & \frac{\partial}{\partial p_{Cy}}E_R, & \frac{\partial}{\partial p_{Cz}}E_R \end{bmatrix} \tag{31}$$

where $P_{cx}$ represents the position of the c-th output cluster (from 1 to c) along x axis in the 3 Cartesian coordinates, $P_{cy}$ represents the position of the c-th output cluster along y axis in the 3 Cartesian coordinates, $P_{cz}$ represents the position of the c-th output cluster along z axis in the 3 Cartesian coordinates. For the metric (D) we have:

$$\frac{\partial}{\partial p_{cx}} E_R = 2\sum_s n_s \sum_o w_o\left(g_{o,s} - \sum_c g_{o,c} g_{c,s}\right)\left(-g_{o,c}\frac{\partial}{\partial p_{cx}} g_{c,s}\right) \tag{32}$$

$$\frac{\partial}{\partial p_{cy}} E_R = 2\sum_s n_s \sum_o w_o\left(g_{o,s} - \sum_c g_{o,c} g_{c,s}\right)\left(-g_{o,c}\frac{\partial}{\partial p_{cy}} g_{c,s}\right) \tag{33}$$

$$\frac{\partial}{\partial p_{cz}} E_R = 2\sum_s n_s \sum_o w_o\left(g_{o,s} - \sum_c g_{o,c} g_{c,s}\right)\left(-g_{o,c}\frac{\partial}{\partial p_{cz}} g_{c,s}\right) \tag{34}$$

where $q_{C,S}$ represents the gains of rendering clusters into the reference playback system, $$\frac{\partial}{\partial p_{cx}} g_{c,s},\ \frac{\partial}{\partial p_{cy}} g_{c,s} \text{ and } \frac{\partial}{\partial p_{cz}} g_{c,s}$$

represent the gradients of the rendering gains.

For example, for a standard Atmos renderer, the gain can be calculated as followed, $$g_{C,S}(p_{cx}, p_{cy}, p_{cz}) = f_{sx}(p_{cx}) f_{sy}(p_{cy}) f_{sz}(p_{cz}) \tag{35}$$

where $f_{sx}(\,)$, $f_{sy}(\,)$ and $f_{sz}(\,)$ represent the gain function of the Atmos renderer on the s-th channel regarding an x-position, y-position and z-position respectively, and for the metric (E):

$$\frac{\partial}{\partial P_C} E_C = -(Q_O^T H^T W_O G_{OC})^T - G_{OC}^T W_O H Q_O + (G_{OC}^T W_O G_{OC} + G_{OC}^T W_O G_{OC}) P_C \tag{36}$$

In view of the above, the cluster positions can be determined based on the object-to-cluster gains.

There may be many ways to initialize the cluster position for the iteration process. For example, random initialization or k-means based initialization can be used to initialize the cluster positions for each processing frame. However, to avoid converging to different local minimum in adjacent frames, the obtained cluster positions of the previous frame can be used to initialize the cluster positions of the current frame. Besides, a hybrid method, for example, choosing the cluster positions with the smallest cost from several different initialization methods, can be applied to initialize the determining process.

After performing the either of the steps represented by the blocks 221 and 222, the cost function will be evaluated at a block 223 to test if the value of the cost function is small enough so as to stop the iteration. The iteration will be stopped when the value of the cost function is smaller than a predefined threshold, or the descent rate of the cost function value is very small. The predefined threshold may be set beforehand by a user manually. In another embodiment, the steps represented by the blocks 221 and 222 can be carried out alternately until the value of the cost function or its changing rate is equal to a predefined threshold. In some use case, performing the steps represented by the blocks 221 and 222 in FIG. 2 for an only predetermined number of times may be enough, but rather than performing the steps until the overall error has reached a threshold. Hence, processing of the cluster position determining unit 221 and of the object-to-cluster gain determining unit 222 may be mutually dependent and part of an iteration process until a predetermined condition is met.

It is to be understood that the EM iterative method described above is only an example embodiment, and other rules can also be applied to estimate the cluster positions and the object-to-cluster gains jointly.

The iteration steps or the determining process ensures a number of clusters to be generated with improved accuracy, so that an immersive reproduction of the audio content can be achieved. Meanwhile, a reduced requirement on data transmission rate thanks to the effective compression allows a less compromised fidelity for any of the existing playback systems such as a speaker array and a headphone.

Figure 3:
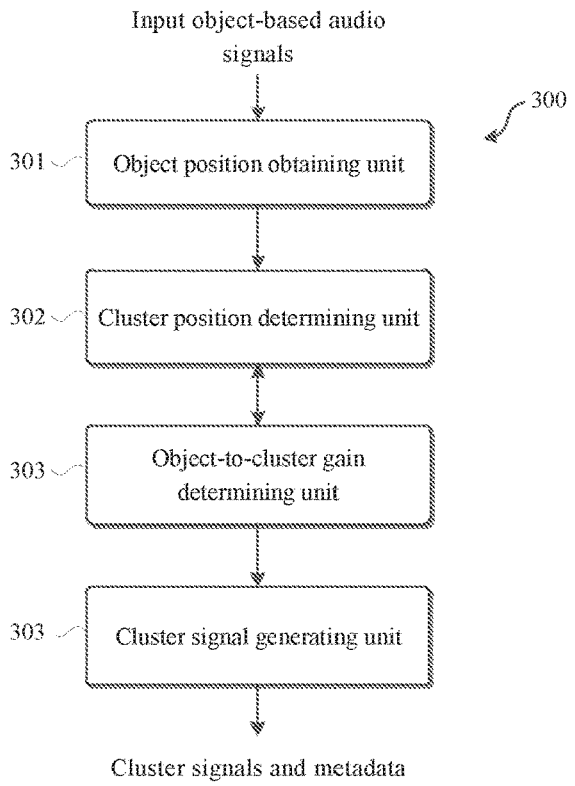
FIG. 3 illustrates a system for processing an audio signal in accordance with an example embodiment.

FIG. 3 illustrates a system 300 for processing an audio signal including a plurality of audio objects in accordance with an example embodiment. As shown, the system 300 includes an object position obtaining unit 301 configured to obtain an object position for each of the audio objects; and a cluster position determining unit 302 configured to determine cluster positions for grouping the audio objects into clusters based on the object positions, a plurality of object-to-cluster gains, and a set of metrics. The metrics indicate a quality of the cluster positions and a quality of the object-to-cluster gains, each of the cluster positions being a centroid of a respective one of the clusters, and one of the object-to-cluster gains defining a ratio of the respective audio object in one of the clusters. The system 300 also includes an object-to-cluster gain determining unit configured to determine the object-to-cluster gains based on the object positions, the cluster positions and the set of metrics; and a cluster signal generating unit 304 configured to generate a cluster signal to be rendered based on the determined cluster positions and object-to-cluster gains.

In an example embodiment, the system 300 may further include an alternative determining unit configured to alternately perform the determining of the cluster positions and the determining of the object-to-cluster gains until a predetermined condition is met. In a further embodiment, the predetermined condition may include at least one of the following: a value associated with the metrics being smaller than a predefined threshold, or a changing rate of the value associated with the metrics being smaller than another predefined threshold.

In another example embodiment, the metrics may comprise at least one of the following: a position error between positions of reconstructed audio objects in the cluster signal and the object positions; a distance error between the cluster positions and the object positions; a deviation of a sum of the object-to-cluster gains from one; a rendering error between rendering the cluster signal to one or more playback systems and rendering the audio signal to the one or more playback systems; and inter-frame inconsistency of a variable between a current time frame and a previous time frame. In a further example embodiment, the variable may comprise at least one of the object-to-cluster gains, the cluster positions, or the positions of the reconstructed audio objects. Alternatively, the alternative determining unit may be further configured to alternately perform the determining of the cluster positions and the determining of the object-to-cluster gains based on a weighted combination of the set of metrics.

In yet another example embodiment, the system 300 may further include a cluster position initializing unit configured to initialize the cluster positions based on at least one of the following: randomly selecting the cluster positions; applying an initial clustering on the plurality of audio objects to obtain the cluster positions; or determining the cluster positions for a current time frame of the audio signal based on the cluster positions for a previous time frame of the audio signal.

For the sake of clarity, some optional components of the system 300 are not shown in FIG. 3. However, it should be appreciated that the features as described above with reference to FIGS. 1-2 are all applicable to the system 300. Moreover, the components of the system 300 may be a hardware module or a software unit module. For example, in some embodiments, the system 300 may be implemented partially or completely with software and/or firmware, for example, implemented as a computer program product embodied in a computer readable medium. Alternatively or additionally, the system 300 may be implemented partially or completely based on hardware, for example, as an integrated circuit (IC), an application-specific integrated circuit (ASIC), a system on chip (SOC), a field programmable gate array (FPGA), and so forth. The scope of the present invention is not limited in this regard.

Figure 4:
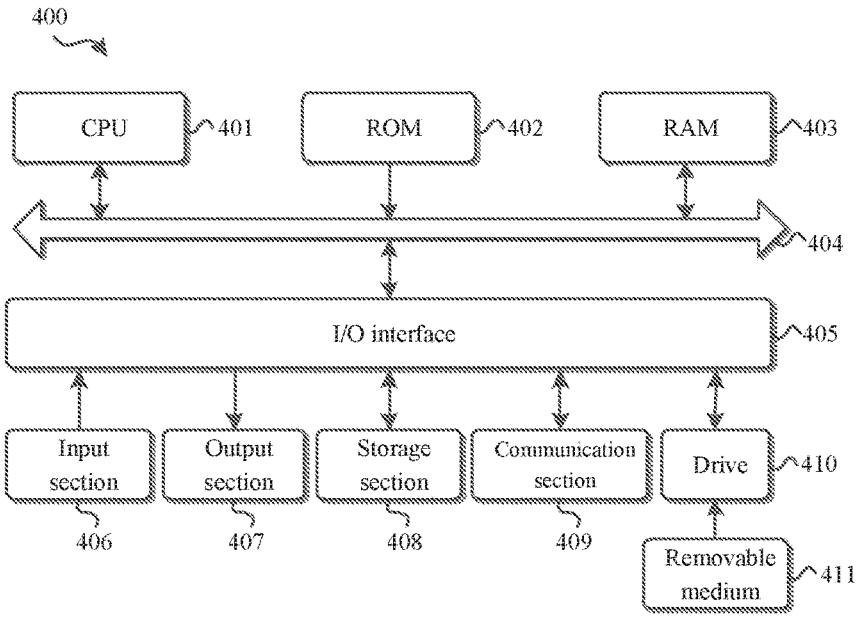
FIG. 4 illustrates a block diagram of an example computer system suitable for the implementing example embodiments disclosed herein.

FIG. 4 shows a block diagram of an example computer system 400 suitable for implementing example embodiments disclosed herein. As shown, the computer system 400 comprises a central processing unit (CPU) 401 which is capable of performing various processes in accordance with a program stored in a read only memory (ROM) 402 or a program loaded from a storage section 408 to a random access memory (RAM) 403. In the RAM 403, data required when the CPU 401 performs the various processes or the like is also stored as required. The CPU 401, the ROM 402 and the RAM 403 are connected to one another via a bus 404. An input/output (I/O) interface 405 is also connected to the bus 404.

The following components are connected to the I/O interface 405: an input section 406 including a keyboard, a mouse, or the like; an output section 407 including a display, such as a cathode ray tube (CRT), a liquid crystal display (LCD), or the like, and a speaker or the like; the storage section 408 including a hard disk or the like; and a communication section 409 including a network interface card such as a LAN card, a modem, or the like. The communication section 409 performs a communication process via the network such as the internet. A drive 410 is also connected to the I/O interface 405 as required. A removable medium 411, such as a magnetic disk, an optical disk, a magneto-optical disk, a semiconductor memory, or the like, is mounted on the drive 410 as required, so that a computer program read therefrom is installed into the storage section 408 as required.

Specifically, in accordance with the example embodiments disclosed herein, the processes described above with reference to FIGS. 1-2 may be implemented as computer software programs. For example, example embodiments disclosed herein comprise a computer program product including a computer program tangibly embodied on a machine readable medium, the computer program including program code for performing methods 100. In such embodiments, the computer program may be downloaded and mounted from the network via the communication section 409, and/or installed from the removable medium 411.

Generally speaking, various example embodiments disclosed herein may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments disclosed herein are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, example embodiments disclosed herein include a computer program product comprising a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include, but not limited to, an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the present invention may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server or distributed among one or more remote computers or servers.

Further, while operations are depicted in a particular order, this should not be understood as requiring that such operations be performed in the particular order shown or in a sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable sub-combination.

Various modifications, adaptations to the foregoing example embodiments of this invention may become apparent to those skilled in the relevant arts in view of the foregoing description, when read in conjunction with the accompanying drawings. Any and all modifications will still fall within the scope of the non-limiting and example embodiments of this invention. Furthermore, other example embodiments set forth herein will come to mind of one skilled in the art to which these embodiments pertain to having the benefit of the teachings presented in the foregoing descriptions and the drawings.

Accordingly, the example embodiments disclosed herein may be embodied in any of the forms described herein. For example, the following enumerated example embodiments (EEEs) describe some structures, features, and functionalities of some aspects of the present invention.

EEE 1. A method of processing object-based audio data comprising:

Determining an multiple metrics based cost function for combining first plurality of audio objects into a second plurality of audio objects.

Combining first plurality of audio objects into a second plurality of audio objects by jointly optimizing the spatial positions and the rendering gains of the second plurality of audio objects to minimize the cost function.

EEE 2. The method of EEE 1 wherein the multiple metrics comprising at least one of:

Spatial representation

Timbre preservation

Loudness preservation

Single channel quality

Temporal smoothness

EEE 3. The method of EEE 2 wherein the spatial representation could be measured by object reconstructed position error.

EEE 4. The method of EEE 2 wherein the timbre preservation could be measured by object-to-cluster distance.

EEE 5. The method of EEE 2 wherein the loudness preservation could be measured by object-to-cluster gain normalization error.

EEE 6. The method of EEE 2 wherein the single channel quality could be measured by the rendering error on at least one or more of predefined reference playback systems.

EEE 7. The method of EEE 2 wherein the temporal smoothness could be measured by inter-frame inconsistence of at least one of variables in clustering results.

EEE 8. The method of EEE 7 wherein the variable could be object-to-cluster gains, cluster position or reconstructed object position.

EEE 9. The method of EEE 1 wherein the cost function could be a combination based on the cost terms of multiple metrics.

EEE 10. The method of EEE 9 in which different weights are applied to said cost terms of multiple metrics.

EEE 11. The method of EEE 10 in which said different weights are determined in response to human input.

EEE 12. The method of EEE 11 wherein an E-M like iterative optimization method could be used to minimize the cost function.

EEE 13. The method of any of the previous EEEs, in which one or more reference loudspeaker setups are determined by human input.

EEE 14. The method of any of the previous EEEs, in which the reference renderer could be any of speaker renderers or headphone renderers.

Additional EEEs (AEEEs) are:

AEEE 1. A method of processing an audio signal including a plurality of audio objects, comprising: obtaining an object position for each of the audio objects; determining cluster positions for grouping the audio objects into clusters based on the object positions, a plurality of object-to-cluster gains, and a set of metrics, the metrics indicating a quality of the cluster positions and a quality of the object-to-cluster gains, each of the cluster positions being a centroid of a respective one of the clusters, and one of the object-to-cluster gains defining a ratio of the respective audio object in one of the clusters; determining the object-to-cluster gains based on the object positions, the cluster positions and the set of metrics; and generating a cluster signal based on the determined cluster positions and object-to-cluster gains.

AEEE 2. The method according to AEEE 1, further comprising: alternately performing the determining of the cluster positions and the determining of the object-to-cluster gains until a predetermined condition is met.

AEEE 3. The method according to AEEE 2, wherein the predetermined condition includes at least one of the following: a value associated with the metrics being smaller than a predefined threshold, or a changing rate of the value associated with the metrics being smaller than another predefined threshold.

AEEE 4. The method according to any of AEEE 2 or 3, wherein the metrics comprise at least one of the following: a position error between positions of reconstructed audio objects in the cluster signal and the object positions; a distance error between the cluster positions and the object positions; a deviation of a sum of the object-to-cluster gains from one; a rendering error between rendering the cluster signal to one or more playback systems and rendering the audio signal to the one or more playback systems; or inter-frame inconsistency of a variable between a current time frame and a previous time frame.

AEEE 5. The method according to AEEE 4, wherein the variable comprises at least one of the object-to-cluster gains, the cluster positions, or the positions of the reconstructed audio objects.

AEEE 6. The method according to AEEE 4 or AEEE 5, wherein the alternately performing the determining of the cluster positions and the determining of the object-to-cluster gains is based on a weighted combination of the set of metrics.

AEEE 7. The method according to any of AEEEs 1-6, further comprising: initializing the cluster positions based on at least one of the following: randomly selecting the cluster positions; applying an initial clustering on the plurality of audio objects to obtain the cluster positions; or determining the cluster positions for a current time frame of the audio signal based on the cluster positions for a previous time frame of the audio signal.

AEEE 8. A system for processing an audio signal including a plurality of audio objects, comprising: an object position obtaining unit configured to obtain an object position for each of the audio objects; a cluster position determining unit configured to determine cluster positions for grouping the audio objects into clusters based on the object positions, a plurality of object-to-cluster gains, and a set of metrics, the metrics indicating a quality of the cluster positions and a quality of the object-to-cluster gains, each of the cluster positions being a centroid of a respective one of the clusters, and one of the object-to-cluster gains defining a ratio of the respective audio object in one of the clusters; an object-to-cluster gain determining unit configured to determine the object-to-cluster gains based on the object positions, the cluster positions and the set of metrics; and a cluster signal generating unit configured to generate a cluster signal based on the determined cluster positions and object-to-cluster gains.

AEEE 9. The system according to AEEE 8, further comprising: an alternative determining unit configured to alternately perform the determining of the cluster positions and the determining of the object-to-cluster gains until a predetermined condition is met.

AEEE 10. The system according to AEEE 9, wherein the predetermined condition includes at least one of the following: a value associated with the metrics being smaller than a predefined threshold, or a changing rate of the value associated with the metrics being smaller than another predefined threshold.

AEEE 11. The system according to any of AEEE 9 or 10, wherein the metrics comprise at least one of the following: a position error between positions of reconstructed audio objects in the cluster signal and the object positions; a distance error between the cluster positions and the object positions; a deviation of a sum of the object-to-cluster gains from one; a rendering error between rendering the cluster signal to one or more playback systems and rendering the audio signal to the one or more playback systems; or inter-frame inconsistency of a variable between a current time frame and a previous time frame.

AEEE 12. The system according to AEEE 11, wherein the variable comprises at least one of the object-to-cluster gains, the cluster positions, or the positions of the reconstructed audio objects.

AEEE 13. The system according to AEEE 11 or AEEE 12, wherein the alternative determining unit is further configured to alternately perform the determining of the cluster positions and the determining of the object-to-cluster gains based on a weighted combination of the set of metrics.

AEEE 14. The system according to any of AEEEs 8-13, further comprising:

a cluster position initializing unit configured to initialize the cluster positions based on at least one of the following: randomly selecting the cluster positions; applying an initial clustering on the plurality of audio objects to obtain the cluster positions; or determining the cluster positions for a current time frame of the audio signal based on the cluster positions for a previous time frame of the audio signal.

The invention claimed is:

1. A method of processing an audio signal including a plurality of audio objects, comprising:

obtaining an object position for each of the audio objects;

determining cluster positions for grouping the audio objects into clusters, given a plurality of object-to-cluster gains, based on the object positions and a set of metrics, the metrics indicating a quality of the cluster positions and a quality of the object-to-cluster gains, each of the cluster positions being a centroid of a respective one of the clusters, and the plurality of object-to-cluster gains indicating for each one of the audio objects gains for determining a reconstructed object position of the audio object from the cluster positions of the clusters;

determining the plurality of object-to-cluster gains, given the cluster positions, based on the object positions and the set of metrics; wherein the steps of determining cluster positions and determining the object-to-cluster gains are mutually dependent and part of an iteration process until a predetermined condition is met; and generating a cluster signal based on the determined cluster positions and object-to-cluster gains;

wherein the metrics comprise at least one of the following:

a position error between positions of reconstructed audio objects in the cluster signal and the object positions;

a distance error between the cluster positions and the object positions;

a deviation of a sum of the object-to-cluster gains from one;

a rendering error between rendering the cluster signal to one or more playback systems and rendering the audio signal to the one or more playback systems; or inter-frame inconsistency of a variable between a current time frame and a previous time frame; and wherein the variable comprises at least one of the object-to-cluster gains, the cluster positions, or the positions of the reconstructed audio objects.

2. The method according to claim 1, further comprising:

alternately performing the determining of the cluster positions and the determining of the object-to-cluster gains until the predetermined condition is met.

3. The method according to claim 2, wherein the predetermined condition includes at least one of the following:

a value associated with the metrics being smaller than a predefined threshold, or a changing rate of the value associated with the metrics being smaller than another predefined threshold.

4. The method according to claim 2, wherein the alternately performing the determining of the cluster positions and the determining of the object-to-cluster gains is based on a weighted combination of the set of metrics.

5. The method according to claim 1, further comprising:

initializing the cluster positions based on at least one of the following:

randomly selecting the cluster positions;

applying an initial clustering on the plurality of audio objects to obtain the cluster positions; or determining the cluster positions for a current time frame of the audio signal based on the cluster positions for a previous time frame of the audio signal.

6. The method according to claim 1, wherein a large object-to-cluster gain for an audio object with respect to a cluster indicates that the audio object is in a close vicinity of the cluster, and vice versa;

an object-to-cluster gain for the audio object with respect to a cluster having a cluster position represents the gain of rendering the audio objects to the cluster position of the cluster; and/or the plurality of object-to-cluster gains comprises object-to-cluster gains for each of the plurality of audio objects with respect to each of the clusters.

7. A computer program product for processing an audio signal including a plurality of audio objects, the computer program product being tangibly stored on a non-transient computer-readable medium and comprising machine executable instructions which, when executed, cause the machine to perform steps of the method according to claim 1.

8. A method of processing an audio signal including a plurality of audio objects, comprising:

obtaining an object position for each of the audio objects;

determining cluster positions for grouping the audio objects into clusters, given a plurality of object-to-cluster gains, based on the object positions and a set of metrics, the metrics indicating a quality of the cluster positions and a quality of the object-to-cluster gains, each of the cluster positions being a centroid of a respective one of the clusters, and the plurality of object-to-cluster gains indicating for each one of the audio objects gains for determining a reconstructed object position of the audio object from the cluster positions of the clusters;

determining the plurality of object-to-cluster gains, given the cluster positions, based on the object positions and the set of metrics; wherein the steps of determining cluster positions and determining the object-to-cluster gains are mutually dependent and part of an iteration process until a predetermined condition is met; and generating a cluster signal based on the determined cluster positions and object-to-cluster gains;

wherein $\vec{p}_c$ is a vector representing the cluster position of a $c^{th}$ cluster;

$g_{o,c}$ is the object-to-cluster gain of an $o^{th}$ object with respect to the $c^{th}$ cluster; and $\vec{p}_o'$ is a vector representing the reconstructed object position of the $o^{th}$ object, with $\vec{p}_o'=\Sigma_c g_{o,c}\vec{p}_c$.

9. A system for processing an audio signal including a plurality of audio objects, comprising:

an object position obtaining unit configured to obtain an object position for each of the audio objects;

a cluster position determining unit configured to determine cluster positions for grouping the audio objects into clusters, a plurality of object-to-cluster gains, based on the object positions and a set of metrics, the metrics indicating a quality of the cluster positions and a quality of the object-to-cluster gains, each of the cluster positions being a centroid of a respective one of the clusters, and the plurality of object-to-cluster gains indicating for each one of the audio objects gains for determining a reconstructed object position of the audio object from the cluster positions of the clusters;

an object-to-cluster gain determining unit configured to determine the object-to-cluster gains, given the cluster positions, based on the object positions and the set of metrics; wherein processing of the cluster position determining unit and of the object-to-cluster gain determining unit is mutually dependent and part of an iteration process until a predetermined condition is met; and a cluster signal generating unit configured to generate a cluster signal based on the determined cluster positions and object-to-cluster gains;

wherein the metrics comprise at least one of the following:

a position error between positions of reconstructed audio objects in the cluster signal and the object positions;

a distance error between the cluster positions and the object positions;

a deviation of a sum of the object-to-cluster gains from one;

a rendering error between rendering the cluster signal to one or more playback systems and rendering the audio signal to the one or more playback systems; or inter-frame inconsistency of a variable between a current time frame and a previous time frame; and wherein the variable comprises at least one of the object-to-cluster gains, the cluster positions, or the positions of the reconstructed audio objects.

10. The system according to claim 9, further comprising:

an alternative determining unit configured to alternately perform the determining of the cluster positions and the determining of the object-to-cluster gains until the predetermined condition is met.

11. The system according to claim 10, wherein the predetermined condition includes at least one of the following:

a value associated with the metrics being smaller than a predefined threshold, or a changing rate of the value associated with the metrics being smaller than another predefined threshold.

12. The system according to claim 9, wherein the alternative determining unit is further configured to alternately perform the determining of the cluster positions and the determining of the object-to-cluster gains based on a weighted combination of the set of metrics.

13. The system according to claim 9, further comprising:

a cluster position initializing unit configured to initialize the cluster positions based on at least one of the following:

randomly selecting the cluster positions;

applying an initial clustering on the plurality of audio objects to obtain the cluster positions; or determining the cluster positions for a current time frame of the audio signal based on the cluster positions for a previous time frame of the audio signal.

* * * * *